US012680239B2

(12) United States Patent
Chen et al.

(10) Patent No.: US 12,680,239 B2
(45) Date of Patent: Jul. 14, 2026

(54) SLOPE TRIMMING ATTACHMENT AND WORKING MACHINE

(71) Applicant: SANY HEAVY MACHINERY LIMITED., Kunshan (CN)

(72) Inventors: Hao Chen, Kunshan (CN); Yunlong Zhang, Kunshan (CN); Youfa Cheng, Kunshan (CN)

(73) Assignee: SANY HEAVY MACHINERY LIMITED, Kunshan (CN)

( * ) Notice: Subject to any disclaimer, the term of this patent is extended or adjusted under 35 U.S.C. 154(b) by 252 days.

(21) Appl. No.: 18/560,342

(22) PCT Filed: Apr. 29, 2022

(86) PCT No.: PCT/CN2022/090225
§ 371 (c)(1),
(2) Date: Nov. 10, 2023

(87) PCT Pub. No.: WO2023/045334
PCT Pub. Date: Mar. 30, 2023

(65) Prior Publication Data

US 2024/0229373 A1 Jul. 11, 2024

(30) Foreign Application Priority Data

Sep. 26, 2021 (CN) ..... 202111131849.9

(51) Int. Cl.
*E01C 19/26* (2006.01)
*E02D 3/046* (2006.01)

(52) U.S. Cl.
CPC ..... *E01C 19/264* (2013.01); *E01C 19/266* (2013.01); *E01C 19/268* (2013.01); *E02D 3/046* (2013.01)

(58) Field of Classification Search
CPC .... E01C 19/264; E01C 19/266; E01C 19/268; E02D 3/039; E02D 3/046
See application file for complete search history.

(56) References Cited

FOREIGN PATENT DOCUMENTS

CN 202809462 U 3/2013
CN 107558530 A 1/2018
(Continued)

OTHER PUBLICATIONS

International Search Report dated Jul. 4, 2022; International Application PCT/CN2022/090225.
(Continued)

*Primary Examiner* — Frederick L Lagman
(74) *Attorney, Agent, or Firm* — DINSMORE & SHOHL LLP

(57) ABSTRACT

A slope trimming attachment includes a base, a first cutting device, a leveling mechanism and a turning mechanism. The first cutting device and the leveling mechanism are respectively arranged on the turning mechanism. The turning mechanism is rotatably arranged on the base and is configured to be able to adjust an angle of the cutting surface of the first cutting device relative to the slope surface and an angle of the leveling surface of the leveling mechanism relative to the slope surface through rotation. A working machine with the disclosed slope trimming attachment is not only convenient to operate, but also realizes the simultaneous execution of cutting, leveling and compacting operations on the slope surface, improves the construction efficiency of the slope surface trimming, and thereby ensuring the construction quality.

11 Claims, 2 Drawing Sheets

(56) References Cited

FOREIGN PATENT DOCUMENTS

| | | | | | |
|---|---|---|---|---|---|
| CN | 108286272 | A | | 7/2018 | |
| CN | 110067275 | A | | 7/2019 | |
| CN | 209368918 | U | | 9/2019 | |
| CN | 210827635 | U | | 6/2020 | |
| CN | 111877423 | A | | 11/2020 | |
| CN | 112554210 | A | | 3/2021 | |
| CN | 213044542 | U | | 4/2021 | |
| CN | 112761205 | A | | 5/2021 | |
| CN | 113502866 | A | * | 10/2021 | ..... E02F 5/223 |
| CN | 111877423 | B | * | 11/2021 | ..... E02F 3/76 |
| CN | 116497789 | A | * | 7/2023 | ..... E02D 3/039 |
| CN | 117286861 | B | * | 2/2024 | ..... E02D 3/00 |
| DE | 3611191 | A1 | | 10/1987 | |
| JP | 50150904 | U | | 12/1975 | |

OTHER PUBLICATIONS

Written Opinion dated Jul. 4, 2022; International Application PCT/CN2022/090225.
Supplementary European Search Report dated Aug. 31, 2023; European Application 22773392.
European Office Action; Application No. 22773392.0.
Search Report dated Jan. 4, 2024 of corresponding CN patent application No. 202111131849.9.

* cited by examiner

SLOPE TRIMMING ATTACHMENT AND WORKING MACHINE

CROSS-REFERENCE TO RELATED APPLICATIONS

This application is the U.S. National Stage of PCT/CN2022/090225 filed on Apr. 29, 2022, which claims priority to Chinese Patent Application 202111131849.9 filed on Sep. 26, 2021, the entire content of both are incorporated herein by reference in their entirety.

TECHNICAL FIELD

The present application relates to the technical field of working machines, in particular, to a slope trimming attachment and a working machine.

BACKGROUND

At present, manpower or a slope trimmer is usually used to trim the slope surface during road construction, the slope surface can be the side slope of the foundation pit or the road surface with a certain slope. Using manpower to trim the slope surface can ensure the construction quality to a certain extent, but there are problems of time-consuming, labor-intensive and high cost. However, using the slope trimmer to trim the slope requires investment in equipment costs, but compared with manpower operation, the construction efficiency has been greatly improved.

In the related art, a slope trimming device is proposed, and the slope trimming device trims the slope surface by means of the switching operation of cutting and roller compaction. When switching between cutting and roller compaction operations, it is necessary to readjust the position and posture of the work tool, which affects the construction efficiency to a certain extent and is not conducive to ensuring construction quality.

SUMMARY

The present application provides a slope trimming attachment and a working machine, which are used to solve the problem that the existing slope trimming device has low construction efficiency and is not conducive to ensuring construction quality.

The present application provides a slope trimming attachment, including: abase, a first cutting device, a leveling mechanism, and a turning mechanism; the first cutting device and the leveling mechanism are arranged on the turning mechanism; the turning mechanism is rotatably arranged on the base, and the turning mechanism is configured to be able to adjust an angle of a cutting surface of the first cutting device relative to the slope surface and an angle of a leveling surface of the leveling mechanism relative to the slope surface through rotation.

According to a slope trimming attachment provided by the present application, the first cutting device and the leveling mechanism are detachably connected to the turning mechanism respectively, and the cutting surface of the first cutting device and the leveling surface of the leveling mechanism have the same orientation; or, the first cutting device and the leveling mechanism are adjustably arranged on the turning mechanism respectively, and an inclined angle of at least one of the cutting surface of the first cutting device and the leveling surface of the leveling mechanism relative to the turning mechanism is adjustable.

According to a slope trimming attachment provided by the present application, the turning mechanism is arranged on at least one of two ends of the base in a first direction; the turning mechanism is rotatable relative to the base along an axis in a second direction; the first direction is along a length direction of the base, and the second direction is along a width direction of the base.

According to a slope trimming attachment provided by the present application, the first cutting device includes a first blade arranged on at least one of two ends of the turning mechanism in the second direction.

According to a slope trimming attachment provided by the present application, the turning mechanism includes a turning plate assembly and a drive assembly; one end of the turning plate assembly is rotatably connected to the base; the drive assembly is connected between the base and the turning plate assembly; the first cutting device and the leveling mechanism are installed on the turning plate assembly.

According to a slope trimming attachment provided by the present application, the turning plate assembly includes a turning plate and a connecting plate; one end of the connecting plate is rotatably connected to the base, and the other end of the connecting plate is rotatably connected to one end of the turning plate; the first cutting device and the leveling mechanism are installed on the turning plate; the drive assembly is connected between the base and the turning plate; wherein the drive assembly is configured to adjust an angular position of the connecting plate relative to the base and an angular position of the turning plate relative to the connecting plate.

According to a slope trimming attachment provided by the present application, the drive assembly includes a first telescopic drive mechanism and a second telescopic drive mechanism; one end of the first telescopic drive mechanism is rotatably connected to a first position of the base, one end of the second telescopic drive mechanism is rotatably connected to a second position of the base, and the other end of the first telescopic drive mechanism is rotatably connected to a third position of the turning plate, and the other end of the second telescopic drive mechanism is rotatably connected to a fourth position of the turning plate; wherein the first position is higher than the second position, and the third position is farther from the connecting plate than the fourth position.

According to a slope trimming attachment provided by the present application, the base includes a bottom plate and a connecting portion; the turning mechanism is rotatably arranged on the bottom plate; the connecting portion is installed on the bottom plate, and the connecting portion is used to connect to a movable working machine body.

According to a slope trimming attachment provided by the present application, two ends of the base in the first direction are respectively provided with the turning mechanism, and the connecting portion is arranged in the middle of the base; and/or, the connecting portion is provided with a first hinge point and a second hinge point, and the first hinge point and the second hinge point are arranged at intervals along the second direction.

According to a slope trimming attachment provided by the present application, the base further includes a support base installed on the bottom plate; the support base is configured to install a drive assembly which drives the turning mechanism to rotate.

According to a slope trimming attachment provided by the present application, the leveling mechanism includes a vibration mechanism and a tamping plate; an output end of the vibration mechanism is connected to a first surface of the tamping plate away from the slope surface, and a second surface of the tamper plate close to the slope surface is the leveling surface; the output end of the vibration mechanism is configured to vibrate back and forth along a direction perpendicular to the first surface.

According to a slope trimming attachment provided by the present application, further including: a second cutting device; the second cutting device includes a second blade; the second blade is arranged on at least one of two ends of the base in the second direction.

The present application also provides a working machine, including a movable work machine body, and the above slope trimming attachment, the slope trimming attachment is installed on the working machine body.

The working machine body according to the present application includes a boom and a third telescopic drive mechanism; an execution end of the boom is hinged with a first hinge point arranged on the base of the slope trimming attachment; one end of the third telescopic drive mechanism is hinged with the boom, and the other end of the third telescopic drive mechanism is hinged with a second hinge point arranged on the base of the slope trimming attachment.

A slope trimming attachment and a working machine are provided in the present application, by rotatably arranging the turning mechanism on the base, and arranging the first cutting device and the leveling mechanism on the turning mechanism, the angle of the cutting surface and the leveling surface of the leveling mechanism relative to the slope surface can be adjusted through the rotation of the turning mechanism, so that when the first cutting device performs the cutting operation on the slope surface, the leveling mechanism can also perform the leveling and compaction operation on the slope surface synchronously, so as to realize the trimming operation of the slope surface. Therefore, the slope trimming attachment provided by the present application is not only convenient to operate, but also realizes the simultaneous execution of cutting, leveling and compacting operations on the slope surface, improves the construction efficiency of the slope surface trim, and thereby ensuring construction quality.

BRIEF DESCRIPTION OF DRAWINGS

In order to illustrate the technical solutions in the present application or the prior art more clearly, the following briefly introduces the accompanying drawings that are used in the description of the embodiments or the prior art. Apparently, the drawings in the following description are some embodiments of the application, for those of ordinary skill in the art, other drawings can also be obtained according to these drawings without any creative effort.

Reference numbers are as following:

1: slope trimming attachment; 11: base; 12: first cutting device; 13: leveling mechanism; 14: turning mechanism; 110: connecting portion; 111: bottom plate; 112: support base; 130: vibration mechanism; 131: tamping plate; 141: turning plate assembly; 142: drive assembly; 401: turning plate; 402: connecting plate; 411: first telescopic drive mechanism; 15: second cutting device; 2: walking mechanism; 412: second telescopic drive mechanism; 3: slewing mechanism; 4: boom; 5: third telescopic drive mechanism; 6: on-board system; 121: first blade; 151: second blade.

DETAILED DESCRIPTIONS

In order to make the purpose, technical solutions and advantages of the present application clearer, the technical solutions in the present application will be described below with reference to the accompanying drawings in the present application. Apparently, the described embodiments are only part of the embodiments of the present application, not all embodiments. Based on the embodiments in the present application, all other embodiments obtained by those of ordinary skill in the art without creative work fall within the protection scope of the present application.

Figure 1:
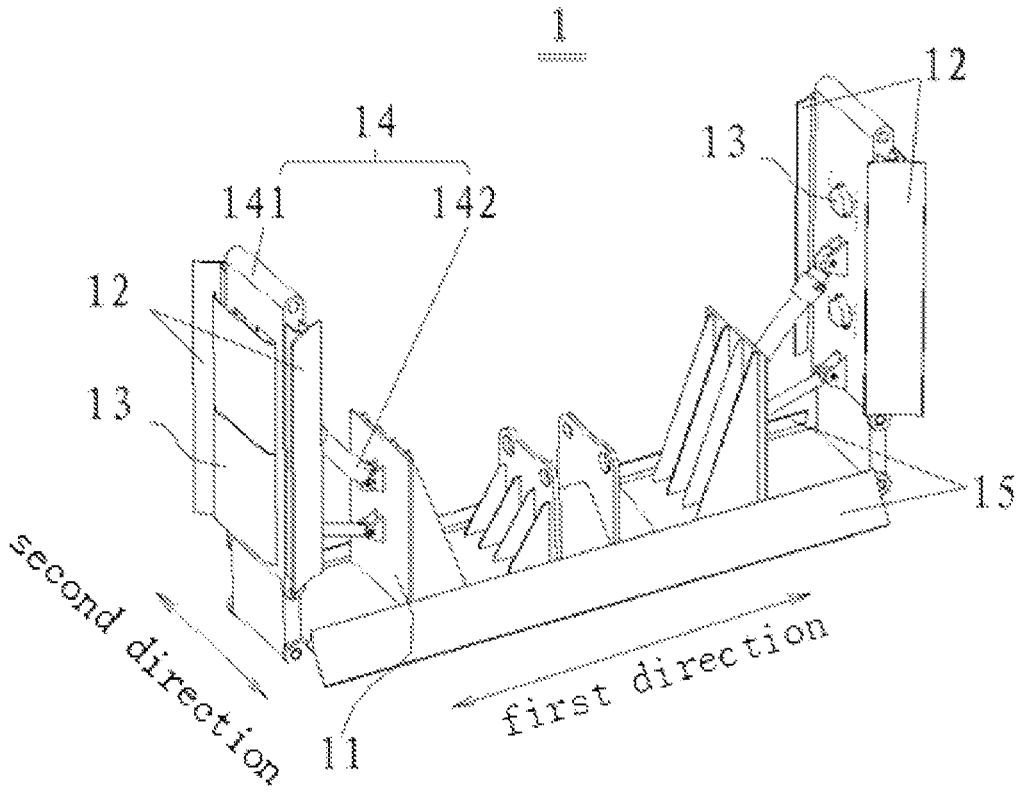
FIG. 1 is a schematic diagram of slope trimming attachment provided in an embodiment of the present application.
Figure 2:
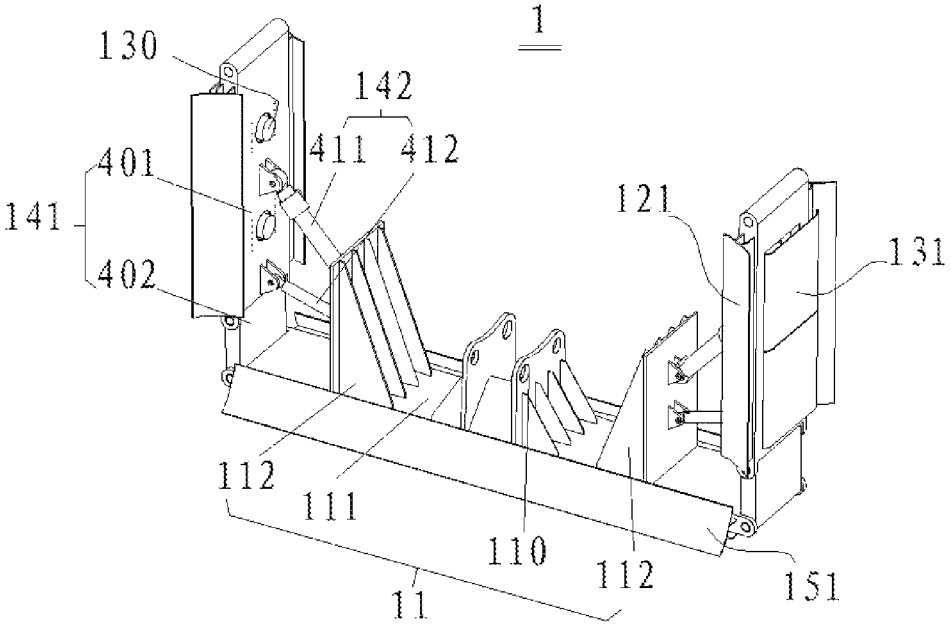
FIG. 2 is a schematic diagram of slope trimming attachment provided in an embodiment of the present application.
Figure 3:
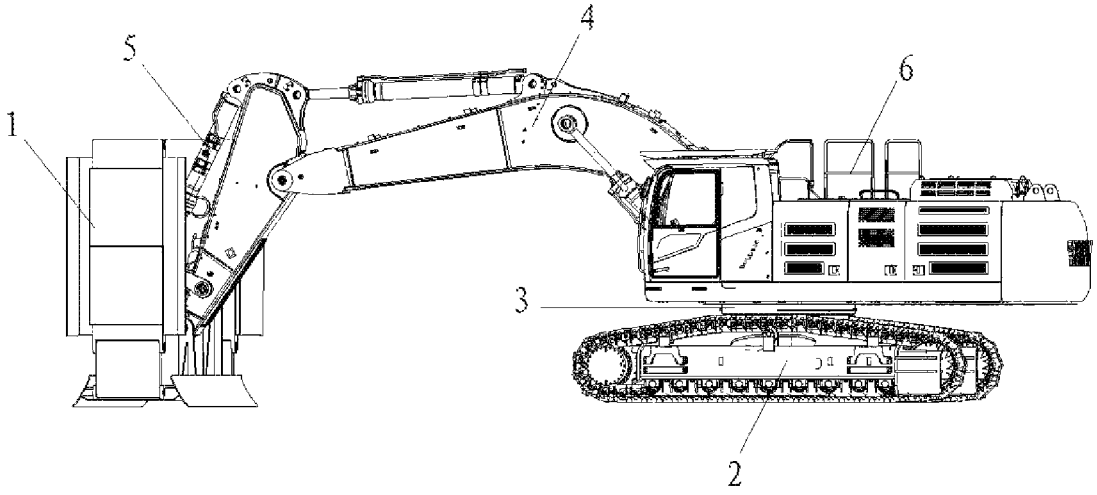
FIG. 3 is a schematic diagram of a working machine provided in an embodiment of the present application.

The following describes a slope trimming attachment and a working machine of the present application with reference to FIGS. 1-3.

As shown in FIG. 1 and FIG. 2, the present embodiment provides a slope trimming attachment. The slope trimming attachment 1 includes: a base 11, a first cutting device 12, a leveling mechanism 13 and a turning mechanism 14. The first cutting device 12 and the leveling mechanism 13 are arranged on the turning mechanism 14; the turning mechanism 14 is rotatably arranged on the base 11, and an angle of the cutting surface of the first cutting device 12 relative to the slope surface and an angle of the leveling surface of the leveling mechanism 13 relative to the slope surface can be adjusted through rotating of the turning mechanism 14, so that the cutting surface of the first cutting device 12 and the leveling mechanism 13 have a suitable trimming angle relative to the slope surface to be trimmed.

Specifically, in the present embodiment, the turning mechanism 14 is rotatably arranged on the base 11, and the first cutting device 12 and the leveling mechanism 13 are arranged on the turning mechanism 14, the angle of the cutting surface of the first cutting device 12 and the leveling surface of the leveling mechanism 13 relative to the slope surface can be adjusted synchronously by the turning mechanism 14, so that when the first cutting device 12 performs the cutting operation on the slope surface, the leveling mechanism 13 can also perform the leveling and compaction operation on the slope surface synchronously, so as to realize the trimming of the slope surface.

Therefore, the present application is not only convenient to operate, but also realizes the simultaneous execution of cutting, leveling and compacting operations on the slope surface, improves the construction efficiency of the slope surface trimming, and thereby ensuring the construction quality.

It should be pointed out here that the first cutting device 12 and the leveling mechanism 13 shown in the present embodiment are arranged on the turning mechanism 14, which can be understood as there are one or more turning mechanisms 14, and each turning mechanism is provided with the first cutting device 12 and the leveling mechanism 13, so that the turning mechanism 14 can synchronously adjust the angle of the cutting surface of the first cutting device 12 and the leveling surface of the leveling mechanism 13 relative to the slope surface, so that when the cutting surface cuts the slope surface, the leveling surface can compact the slope surface. In a specific embodiment, the first cutting device 12 and the leveling mechanism 13 can be arranged on the opposite side of the turning mechanism 14 along the second direction, or a plurality of first cutting devices 12 can be arranged, and the plurality of first cutting devices 12 can be arranged on the opposite side of the turning mechanism 14 along the second direction. The leveling mechanism 13 is arranged in the middle of the turning mechanism 14, one or more of the leveling mechanisms 13 can be arranged in the middle position.

At the same time, the first cutting device 12 and the leveling mechanism 13 shown in this embodiment are arranged on the turning mechanism 14. It can also be understood that, in the case where a plurality of turning mechanisms 14 are arranged to be adjacent, the first cutting device 12 is arranged on one of the turning mechanisms. a leveling mechanism 13 is arranged on the other turning mechanism, so that through two different turning mechanisms, the angle of the cutting surface of the first cutting device 12 relative to the slope surface and the angle of the leveling surface of the leveling mechanism 13 relative to the slope surface can be adjusted respectively.

Apparently, the first cutting device 12 and the leveling mechanism 13 have other arrangements on the turning mechanism 14, which are not listed here.

Furthermore, in the present embodiment, the first cutting device 12 and the leveling mechanism 13 are detachably connected to the turning mechanism 14 respectively in the form of bolt connection or multiple pin connections, so as to ensure the cutting surface of the first cutting device 12 and the leveling surface of the leveling mechanism 13 have the same orientation when installed on the turning mechanism 14, and are both used to face the slope surface to be trimmed. Since the turning mechanism 14 can rotate relative to the base 11, and the first cutting device 12 and the leveling mechanism 13 are respectively arranged on the turning mechanism 14, with the rotating of the turning mechanism 14, the inclined angle of the cutting surface of the first cutting device 12 and the leveling surface of the leveling mechanism 13 relative to the horizontal surface also changes accordingly. In this way, the rotating angle of the turning mechanism 14 can be controlled based on the inclined angle of the slope surface in the present embodiment, so that the cutting surface of the first cutting device 12 cuts the soil at a suitable angle and the leveling mechanism 13 compacts the slope surface at a suitable angle, so as to facilitate the trimming of the slope surface.

At the same time, in the present embodiment, the first cutting device 12 and the leveling mechanism 13 can also be adjusted separately on the turning mechanism 14, and the inclined angle of at least one of the cutting surface of the first cutting device 12 and the leveling surface of the leveling mechanism 13 relative to the turning mechanism can be adjusted.

Here, in the present embodiment, the first cutting device 12 and the leveling mechanism 13 can be respectively installed on the turning mechanism 14 through an angle adjustment bracket known in the art, so that the inclined angle of the cutting surface of the first cutting device 12 and the leveling surface of the leveling mechanism 13 relative to the turning mechanism are both adjustable. Thus, in practical applications, the positions of the first cutting device 12 and the leveling mechanism 13 relative to the slope surface can initially be adjusted based on the turning mechanism 14 in the embodiment, and then the inclined angle of the cutting surface of the first cutting device 12 and the leveling surface of the leveling mechanism 13 relative to the slope surface are finely adjusted respectively based on angle adjustment bracket in order to ensure the accuracy of the trimming of the slope surface.

It should be pointed out here that the first cutting device 12 described in this embodiment cannot automatically cut the slope surface, but only the slope trimming attachment moves relative to the slope surface when the cutting surface of the first cutting device 12 is adjusted to an appropriate angular position, the first cutting device 12 can realize the cutting and soil removal of the slope surface. Here, the movement of the slope trimming attachment can be driven manually or by a working machine. The first cutting device 12 may be a surface blade, a bucket, a fork-shaped shovel, or a rake-shaped shovel or the like known in the art, which is not specifically limited here.

At the same time, the turning mechanism 14 shown in this embodiment may be a manual adjustment bracket known in the art, or an angle adjustment mechanism driven by a telescopic drive mechanism or a rotary drive mechanism, which is not specifically limited here, as long as the turning mechanism 14 can synchronously adjust the angles of the cutting surface of the first cutting device 12 and the leveling surface of the leveling mechanism 13 relative to the slope surface. One or more of the turning mechanisms 14 shown in this embodiment may be provided. In the case where a plurality of turning mechanisms 14 are arranged, the corresponding rotating axes of at least two turning mechanisms 14 are at a predetermined included angle when rotating, the predetermined included angle is 0°-90°.

In addition, the leveling mechanism 13 shown in the embodiment has a leveling surface, and the leveling surface may be a roller surface or a plate surface. In the case where the leveling surface is the roller surface, the leveling mechanism 13 can realize the compaction and leveling of the slope surface based on the rolling contact between the roller surface and the slope surface; and in the case where the leveling surface is the plate surface, based on the high-frequency vibration of the plate surface relative to the slope surface, the leveling mechanism 13 can realize the compaction and leveling of the slope surface.

Optionally, in order to facilitate trimming of the slope surfaces on both sides of the working machine in the advancing direction, the turning mechanism 14 shown in the embodiment is arranged on at least one of the two ends of the base 11 in the first direction; the turning mechanism 14 is rotatable relative to the base 11 along the axis in the second direction; the first direction is perpendicular to the second direction. The first direction is along the length direction of the base 11, and the second direction is along the width direction of the base 11.

Specifically, when the turning mechanism 14 is arranged to be one in the embodiment, the turning mechanism 14 is arranged at the left end or the right end of the base 11 along the length direction of the base 11.

As shown in FIG. 1 and FIG. 2, when multiple turning mechanisms 14 are arranged, the multiple turning mechanisms 14 are arranged at both ends of the base 11 along the length direction of the base 11. FIGS. 1 and 2 show that turning mechanisms 14 is respectively arranged at both ends of the base 1. Since each turning mechanism 14 is provided with a first cutting device 12 and a leveling mechanism 13. The slope surfaces on both sides of the foundation pit can be trimmed at the same time when the working machine drives the slope trimming attachment 1 to advance along the extension direction of the foundation pit. In the case that the slopes of the slope surfaces on both sides of the foundation pit are different, the turning mechanisms 14 on both ends of the base 11 can be individually controlled to meet the trimming requirements for different slope surfaces.

Furthermore, the first cutting device 12 shown in the embodiment includes a first blade 121, and the first blade 121 is arranged on at least one of the two ends of the turning mechanism 14 in the second direction.

As shown in FIG. 1 and FIG. 2, there are two first blades 121 in the embodiment, the two first blades 121 are respectively arranged on opposite sides of the turning mechanism 14 along the second direction, and the leveling mechanism 13 is arranged between the first blades 121 on both sides.

It should be pointed out here that the first cutting device 12 shown in the embodiment may also include other forms of cutting structures, for example, the cutting structures are fork-shaped shovels or rake-shaped shovels, etc., which are not specifically limited here.

As shown in FIGS. 1 and 2, the turning mechanism 14 in the embodiment includes a turning plate assembly 141 and a drive assembly 142; one end of the turning plate assembly 141 is rotatably connected to the base 11; the drive assembly 142 is connected between the base 11 and the turning plate assembly 141; the first cutting device 12 and the leveling mechanism 13 are installed on the turning plate assembly 141.

In the embodiment, the turning plate assembly 141 can be driven to rotate relative to the base 11 by the drive assembly 142, so that the first cutting device 12 and the leveling mechanism 13 are synchronously suitable for trimming the slope surface.

The drive assembly 142 shown in the embodiment may include a telescopic driving mechanism or a rotating driving mechanism, for example, the telescopic driving mechanism may be a cylinder or hydraulic cylinder known in the art, and the rotating driving mechanism may be a hydraulic motor or a servo motor.

In a specific embodiment, the turning plate assembly 141 includes a turning plate 401 and a connecting plate 402; one end of the connecting plate 402 is rotatably connected to the base 11 through a first pin along the second direction, and the other end of the connecting plate 402 is rotatably connected to one end of the turning plate 401 through a first pin along the second direction; the first cutting device 12 and the leveling mechanism 13 are installed on the turning plate 401; the drive assembly 142 is connected between the base 11 and the turning plate 401; in order to ensure the trimming effect on the slope surface, the first cutting device 12 is provided with two first blade 121, the two first blades 121 are respectively arranged on opposite sides of the turning plate 401 along the second direction, and at least one leveling mechanism 13 is arranged and installed in the middle of the turning plate 401.

Here, the drive assembly 142 shown in the embodiment is arranged to be able to adjust the angular position of the connecting plate 402 relative to the base 11 and the angular position of the turning plate 401 relative to the connecting plate 402, that is, by adjusting the angular position of the connecting plate 402 relative to the base 11, the angle of the turning plate 401 can be adjusted. The rotating angle of the turning plate 401 is adjusted based on the position of the lower end (the end is connected to the connecting plate 402), so that there is a suitable distance and a suitable angle between the turning plate 401 and the slope surface to be trimmed. Specifically, the drive assembly 142 can drive the lower end of the turning plate 401 to a certain position close to the inside of the base 11 to adjust the turning plate 401 to a proper angle; or, the drive assembly 142 can drive the lower end of the turning plate 401 to a certain position away from the outside of the base 11 to adjust the turning plate 401 to a proper angle; or, the drive assembly 142 is used to drive the turning plate 401 to move relative to the base 11 along the first direction.

The drive assembly 142 shown in the embodiment includes a first telescopic drive mechanism 411 and a second telescopic drive mechanism 412; one end of the first telescopic drive mechanism 411 (one of the fixed end and the driving end) and one end of the second telescopic drive mechanism 412 (one of the fixed end and the driving end) are rotatably connected to the base 11, the other end of the first telescopic drive mechanism 411 (the other end of the fixed end and the driving end), and the other end of the second telescopic drive mechanism 412 (the other end of the fixed end and the driving end) are rotatably connected to the turning plate 401; the angular position of the connecting plate 402 relative to the base 11 and the angular position of the turning plate 401 relative to the connecting plate 402 can be adjusted through the first telescopic drive mechanism 411 and the second telescopic drive mechanism 412, so that the first cutting device 12 and the leveling mechanism 13 on the turning plate 401 are in a suitable position and the appropriate angle to trim the slope surface.

In a specific embodiment, one end of the first telescopic drive mechanism 411 is rotatably connected to the first position of the base 11, one end of the second telescopic drive mechanism 412 is rotatably connected to the second position of the base 11, and the other end of the first telescopic drive mechanism 411 is rotatably connected to the third position of the turning plate 401. The other end of the second telescopic drive mechanism 412 is rotationally connected to the fourth position of the turning plate 401; the first position is higher than the second position, and the third position is farther from the connecting plate 402 than the fourth position.

Here, in order to ensure the cutting operation effect, both the first telescopic drive mechanism 411 and the second telescopic drive mechanism 412 shown in the embodiment are preferably hydraulic cylinders, which not only ensures that the first telescopic drive mechanism 411 and the second telescopic drive mechanism 412 have sufficient driving force, but also realizes the driving functions of the first telescopic drive mechanism 411 and the second telescopic drive mechanism 412 by using the hydraulic oil source on the working machine.

In practice, the slope surface shown in the embodiment can be understood as an inclined surface with an acute angle. Based on the configuration of the turning plate assembly 141 and the drive assembly 142, the protrusion extent of the telescopic end of the first telescopic drive mechanism 411 can be controlled to be greater than that of the telescopic end of the second telescopic drive mechanism 412 in the embodiment, the upper end of the flap 401 can be controlled to turn outward when the lower end of the turning plate 401 is at a certain position away from the outer side of the base 11, so that the cutting surface of the first cutting device 12 is inclined downward, the turning plate 121 of the turning plate 401 can cut the inclined surface, and the leveling mechanism 13 on the turning plate 401 performs synchronous leveling on the inclined surface. At the same time, the telescopic end of the first telescopic drive mechanism 411 can be controlled to extend in the embodiment, and the telescopic end of the second telescopic drive mechanism 412 to retract, so that the upper end of the flap 401 can be controlled to turn outward and the lower end of the turning plate 401 is at a certain position close to the inner side of the base 11, so that the cutting surface of the first cutting device 12 is inclined downward, and the inclined surface can be cut and leveled at the same time.

The slope surface shown in the embodiment can also be understood as the top surface of the tunnel with an obtuse angle. During tunnel construction, the turning plate 401 can be controlled to rotate toward the inner side of base 11 through the extension and retraction of the first telescopic drive mechanism 411 and the second telescopic drive mechanism 412, so that the cutting surface of first cutting device 12 is inclined upward, and a first blade 121 on turning plate 401 can cut the top surface of the tunnel, and the leveling mechanism 13 of turning plate 401 can synchronously compact and level the top surface of the tunnel.

In addition, the slope surface shown in the embodiment can also be understood as a vertical wall with an inclined angle of 90°. When trimming the vertical wall, the extension and retraction of the first telescopic drive mechanism 411 and the second telescopic drive mechanism 412 can be optimally configured so that the turning plate 401 translates toward the outside of the base 11 along the first direction, and maintains a vertical state during translation, so as to facilitate simultaneous cutting, leveling and compaction of the vertical wall.

As shown in FIG. 1 and FIG. 2, the base 11 shown in the embodiment includes a bottom plate 111 and a connecting portion 110; the turning mechanism 14 is rotatably arranged on the bottom plate 111; the connecting portion 110 is used to connect to a working machine body which can move.

As shown in FIG. 1 and FIG. 2, in order to ensure the balance and stability of the slope trimming attachment during operation, both ends of the base 11 in the first direction are respectively provided with a turning mechanism 14, and the connecting portion 110 shown in the embodiment is arranged in the middle of base 11 along the first direction, that is, between the turning mechanism 14 at both ends of base 11.

At the same time, in order to facilitate the attitude control of the base 11, the connecting portion 110 is provided with a first hinge point and a second hinge point, and the first hinge point and the second hinge point are arranged at intervals along the second direction in the embodiment. Thus, in practical application, the hooking structure on the working machine body can be hinged to one of the first hinge point and the second hinge point, and the telescopic end of the telescopic drive mechanism on the working machine body can be hinged to the other one of the first hinge point and the second hinge point in the embodiment, so that the inclined angle of the base 11 can be controlled by adjusting the telescopic amount of the telescopic drive mechanism.

Furthermore, the base 11 shown in the embodiment further includes a support base 112; the support base 112 is installed on the upper surface of the bottom plate 111, and the support base 112 is configured to install a drive assembly 142 that drives the turning mechanism 14 to rotate. Specifically, one end of the turning plate assembly 141 is rotatably connected to the bottom plate 111, and the drive assembly 142 is connected between the support base 112 and the turning plate assembly 141.

Here, since the support base 112 is the main load-bearing component of the drive assembly 142, in order to ensure the mechanical strength of the support base 112, the support base 112 shown in the embodiment includes a vertical plate and a stiffening plate, the bottom of the vertical plate is connected to the bottom plate 111, and one side of the stiffening plate is connected to one side of the vertical plate facing away from the turning plate assembly 141, and the other side of the stiffening plate is connected to the bottom plate 111, and there are a plurality of stiffening plates, which are arranged at intervals along the second direction. The first position and the second position shown in the above-mentioned embodiment are arranged on the side of the vertical plate facing the turning plate assembly 141 along the height direction of the base 11.

As shown in FIG. 1 and FIG. 2, the leveling mechanism 13 shown in the embodiment includes a vibration mechanism 130 and a tamping plate 131; the output end of the vibration mechanism 130 is connected to the first surface of the tamping plate 131 facing away from the slope surface, and the second surface of the tamping plate 131 facing the slope surface is used for leveling and compacting the slope surface; the output end of the vibration mechanism 130 can vibrate back and forth along the direction perpendicular to the second surface.

Specifically, the vibration mechanism 130 shown in the embodiment is preferably a hydraulic high frequency vibrator known in the art. The vibration mechanism 130 shown in the embodiment is arranged on the turning plate 401 shown in the above embodiment, and the tamping plate 131 is arranged on the side of the turning plate 401 facing the slope surface.

Furthermore, a plurality of leveling mechanisms 13 shown in the embodiment may be arranged, the plurality of leveling mechanisms 13 are arranged along the extending direction of the turning plate 401 away from the connecting plate 402, and the leveling surfaces of the plurality of leveling mechanisms 13 are flush, that is, the plurality of leveling mechanisms 13 corresponding to the second surface of tamping plate 131 are flush. In order to ensure the leveling effect on the slope surface and reduce the resonance generated during operation, the multiple leveling mechanisms 13 can be controlled to operate alternately in sequence, or the multiple leveling mechanisms 13 can be controlled to operate synchronously, but the vibration mechanism 130 corresponding to each leveling mechanism 13 should be ensured to vibrate at different frequencies.

Preferably, the slope trimming attachment 1 shown in the embodiment is further provided with a second cutting device 15, and the second cutting device 15 includes a second blade 151; the second blade 151 is arranged on at least one of the two ends of the base 11 in the second direction.

As shown in FIG. 1 and FIG. 2, there are two second blades 151, and the two second blades 151 are respectively arranged on opposite sides of the bottom plate 111 corresponding to the base 11 along the second direction. In this way, when the working machine walks along the foundation pit, the second blade 151 move relative to the pit bottom of the foundation pit since the working machine is connected to the base 11, thereby realizing the trimming of the pit bottom.

It should be noted here that the second cutting device 15 shown in the embodiment may also include other forms of cutting structures, for example, the cutting structures are fork-shaped shovels or rake-shaped shovels, etc., which are not specifically limited herein.

Preferably, the present embodiment also provides a working machine, which includes a movable working machine body and the above-mentioned slope trimming attachment 1, the slope trimming attachment 1 is installed on the working machine body. In the embodiment, the working machine body may be the main structure of an excavator or a bulldozer, and the slope trimming attachment 1 may be installed instead of the bucket of the excavator or bulldozer.

Specifically, since the working machine shown in the embodiment includes the slope trimming attachment 1 shown in the foregoing embodiment, the embodiment adopts all the technical solutions of all the foregoing embodiments, and therefore at least has the technical solutions of the foregoing embodiments. All the beneficial effects will not be repeated here.

As shown in FIG. 3, the working machine body shown in the embodiment includes a boom 4 and a third telescopic drive mechanism 5; the execution end of boom 4 is hinged with the first hinge point arranged on the base 11 of the slope trimming attachment 1; one end of the third telescopic drive mechanism 5 is hinged with the boom 4, the other end of the third telescopic drive mechanism 5 is hinged with the second hinge point arranged on the base 11 of the slope trimming attachment 1.

Here, in the present embodiment, the head end of the boom 4 can be installed on a fixed platform or a walking platform. When the working machine body is a carrying platform based on an excavator, the working machine body further includes a walking mechanism 2 and a slewing mechanism 3; the slewing mechanism 3 is arranged on the walking mechanism 2; the head end of the boom 4 is arranged on the slewing mechanism 3. The walking mechanism 2 shown in this embodiment is preferably a crawler-type walking mechanism. In order to facilitate the driving operation of the working machine, the slewing mechanism 3 is also provided with an upper-carriage system 6 in the embodiment.

As shown in FIG. 3, the boom 4 shown in the embodiment includes a swing arm, a swing arm cylinder, a stick and a stick cylinder; one end of the swing arm and one end of the swing arm cylinder are respectively hinged with the slewing mechanism 3, and the other end of the swing arm cylinder is hinged with the middle of the swing arm, the other end of the swing arm is hinged with the first end of the stick, the second end of the stick is hinged with the first hinge point; one end of the stick cylinder is hinged with the middle of the swing arm, and the other end of the stick cylinder is hinged with the third end of the stick. At the same time, one end of the third telescopic drive mechanism 5 is hinged with the third end of the stick, and the other end of the third telescopic drive mechanism 5 is hinged with the second hinge point. The third telescopic drive mechanism 5 is preferably an oil cylinder known in the art.

In the present embodiment, the angle of the swing arm rotation relative to the slewing mechanism 3 can be controlled by the swing arm cylinder, the angle of the swing arm rotation relative to the swing arm can be controlled by the stick cylinder, and the angle of the slope trimming attachment 1 rotation relative to the stick can also be controlled by the third telescopic drive mechanism 5.

Furthermore, since the boom 4 also rotates relative to the walking mechanism 2 under the control of the slewing mechanism 3, the position and attitude of the slope repairing accessory 1 can be controlled in actual operation under the combined action of the walking mechanism 2, the slewing mechanism 3, the boom 4 and the third telescopic drive mechanism 5 so as to adapt to the trimming of the slope surface under different working conditions.

Finally, it should be noted that the above embodiments are only used to illustrate the technical solutions of the present application, but not to limit them; although the present application has been described in detail with reference to the foregoing embodiments, those of ordinary skill in the art should understand that: modifications can still be made to the technical solutions recorded in the foregoing embodiments, or some technical features thereof are equivalently replaced; and these modifications or replacements do not make the essence of the corresponding technical solutions deviate from the spirit and scope of the technical solutions of the embodiments of the present application.

What is claimed is:

1. A slope trimming attachment, comprising: a base, a first cutting device, a leveling mechanism, and a turning mechanism;

wherein the first cutting device and the leveling mechanism are arranged on the turning mechanism;

the turning mechanism is rotatably arranged on the base, and the turning mechanism is configured to be able to adjust an angle of a cutting surface of the first cutting device relative to the slope surface and an angle of a leveling surface of the leveling mechanism relative to the slope surface through rotation;

wherein the turning mechanism is arranged on at least one of two ends of the base in a first direction; the turning mechanism is rotatable relative to the base along an axis in a second direction; wherein the first direction is along a length direction of the base, and the second direction is along a width direction of the base;

wherein the turning mechanism comprises a turning plate assembly and a drive assembly;

wherein the turning plate assembly comprises a turning plate and a connecting plate; one end of the connecting plate is rotatably connected to the base, and the other end of the connecting plate is rotatably connected to one end of the turning plate; the first cutting device and the leveling mechanism are installed on the turning plate; the drive assembly is connected between the base and the turning plate; and wherein the drive assembly is configured to adjust an angular position of the connecting plate relative to the base and an angular position of the turning plate relative to the connecting plate.

2. The slope trimming attachment according to claim 1, wherein the first cutting device and the leveling mechanism are detachably connected to the turning mechanism respectively, and the cutting surface of the first cutting device and the leveling surface of the leveling mechanism have the same orientation;

or, the first cutting device and the leveling mechanism are adjustably arranged on the turning mechanism respectively, and an inclined angle of at least one of the cutting surface of the first cutting device and the leveling surface of the leveling mechanism relative to the turning mechanism is adjustable.

3. The slope trimming attachment according to claim 1, wherein the first cutting device comprises a first blade arranged on at least one of two ends of the turning mechanism in the second direction.

4. The slope trimming attachment according to claim 1, wherein the drive assembly comprises a first telescopic drive mechanism and a second telescopic drive mechanism;

one end of the first telescopic drive mechanism is rotatably connected to a first position of the base, one end of the second telescopic drive mechanism is rotatably connected to a second position of the base, and the other end of the first telescopic drive mechanism is rotatably connected to a third position of the turning plate, and the other end of the second telescopic drive mechanism is rotatably connected to a fourth position of the turning plate;

wherein the first position is higher than the second position, and the third position is farther from the connecting plate than the fourth position.

5. The slope trimming attachment according to claim 1, wherein the base comprises a bottom plate and a connecting portion;

the turning mechanism is rotatably arranged on the bottom plate; the connecting portion is installed on the bottom plate, and the connecting portion is used to connect to a working machine body.

6. The slope trimming attachment according to claim 5, wherein two ends of the base in the first direction are respectively provided with the turning mechanism, and the connecting portion is arranged in the middle of the base;

and/or, the connecting portion is provided with a first hinge point and a second hinge point, and the first hinge point and the second hinge point are arranged at intervals along the second direction.

7. The slope trimming attachment according to claim 5, wherein the base further comprises a support base installed on the bottom plate;

the support base is configured to install a drive assembly which drives the turning mechanism to rotate.

8. The slope trimming attachment according to claim 1, wherein the leveling mechanism comprises a vibration mechanism and a tamping plate;

an output end of the vibration mechanism is connected to a first surface of the tamping plate away from the slope surface, and a second surface of the tamper plate close to the slope surface is the leveling surface; the output end of the vibration mechanism is configured to vibrate back and forth along a direction perpendicular to the first surface.

9. The slope trimming attachment according to claim 1, further comprising: a second cutting device;

wherein the second cutting device comprises a second blade, the second blade is arranged on at least one of two ends of the base in the second direction.

10. A working machine, comprising a work machine body, and the slope trimming attachment according to claim 1, wherein the slope trimming attachment is installed on the working machine body.

11. The working machine according to claim 10, wherein the working machine body comprises a boom and a third telescopic drive mechanism;

an execution end of the boom is hinged with a first hinge point arranged on the base of the slope trimming attachment; one end of the third telescopic drive mechanism is hinged with the boom, and the other end of the third telescopic drive mechanism is hinged with a second hinge point arranged on the base of the slope trimming attachment.

* * * * *